US012270583B2

(12) United States Patent
Deokar et al.

(10) Patent No.: US 12,270,583 B2
(45) Date of Patent: Apr. 8, 2025

(54) DISTRIBUTOR SYSTEMS FOR HEAT EXCHANGERS

(71) Applicant: Rheem Manufacturing Company, Atlanta, GA (US)

(72) Inventors: Pratik S. Deokar, Dallas, TX (US); Baojie Mu, Fort Smith, AR (US); Chitra Sadanandan, Lewisville, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 123 days.

(21) Appl. No.: 17/543,974

(22) Filed: Dec. 7, 2021

(65) Prior Publication Data

US 2023/0175749 A1 Jun. 8, 2023

(51) Int. Cl.
*F25B 41/40* (2021.01)
*F25B 39/02* (2006.01)
(Continued)

(52) U.S. Cl.
CPC ..... *F25B 41/40* (2021.01); *F25B 39/02* (2013.01); *F25B 41/22* (2021.01); *F25B 41/26* (2021.01); *F25B 41/38* (2021.01); *F25B 41/31* (2021.01)

(58) Field of Classification Search
CPC ..... F25B 41/48; F25B 41/26; F25B 41/22; F25B 41/38; F25B 41/31; F25B 41/40;
(Continued)

(56) References Cited

U.S. PATENT DOCUMENTS 5,099,877 A * 3/1992 Fluegel ..... F16K 15/03 137/527
5,915,464 A * 6/1999 Kalbacher ..... F28F 27/02 165/DIG. 123
(Continued)

FOREIGN PATENT DOCUMENTS

EP 3284984 A1 * 2/2018 ..... F16K 11/10
FR 3059408 A1 * 6/2018 ..... F28F 13/08
(Continued)

OTHER PUBLICATIONS

FR-3059408-A1 English Translation (Year: 2018).*
(Continued)

*Primary Examiner* — David J Teitelbaum
*Assistant Examiner* — Devon Moore
(74) *Attorney, Agent, or Firm* — Eversheds Sutherland (US) LLP

(57) ABSTRACT

A header tube assembly is disclosed and can include an outer tube, an inner tube, and a flow valve. Each of the outer and inner tubes can include an open end and a closed end, as well as a plurality of apertures extending through a sidewall of the outer tube and inner tube, respectively. The apertures of the inner tube can permit a flow of refrigerant between an internal volume of the inner tube and a gap between the inner and outer tubes, and the apertures of the outer tube can permit a flow of refrigerant between the internal volume of the outer tube and a plurality of refrigerant circuits in a heat exchanger. The flow valve can be configured to selectively prevent refrigerant from flowing between the gap and the open end of the outer tube, depending on a direction of refrigerant flow through the header tube assembly.

18 Claims, 10 Drawing Sheets

(51) Int. Cl.

| | |
|---|---|
| ***F25B 41/22*** | (2021.01) |
| ***F25B 41/26*** | (2021.01) |
| ***F25B 41/31*** | (2021.01) |
| ***F25B 41/38*** | (2021.01) |

(58) Field of Classification Search
CPC ..... F25B 39/02; F25B 2600/25; F25B 2600/2511; F16K 15/00; F16K 15/021; F16K 15/03; F16K 15/031; F16K 15/035; F16K 15/14; F28F 27/02; F28F 9/0263; F28F 9/0273; F28F 9/028
See application file for complete search history.

(56) References Cited

U.S. PATENT DOCUMENTS

2008/0093051 A1* 4/2008 Rios ..... F28F 9/0273 165/61
2011/0017438 A1* 1/2011 Huazhao ..... F28D 1/05316 165/173
2013/0199288 A1* 8/2013 Goenka ..... F28F 9/0263 73/202
2015/0345843 A1* 12/2015 Voorhis ..... F28F 27/02 62/504

FOREIGN PATENT DOCUMENTS

WO WO-2009002256 A1 * 12/2008 ..... F25B 41/062
WO WO-2018019801 A1 * 2/2018 ..... B60K 15/03504

OTHER PUBLICATIONS

WO-2018019801-A1 English Translation (Year: 2018).*
Parker US. "Refrigerant Distributors: A Sporlan Refrigerant Distributor for Most Requirements". Parker Hannifin Corporation. Bulletin 20-10. Feb. 2011.

* cited by examiner

DISTRIBUTOR SYSTEMS FOR HEAT EXCHANGERS

BACKGROUND

Many vapor compression refrigeration systems (e.g., air conditioners, heat pumps) include a heat exchanger having multiple refrigerant circuits. For example, some heat exchangers are designed to split incoming heat transfer fluid (also referenced herein as "refrigerant") into multiple refrigerant or fluid flow paths that each extend along length of the heat exchanger. Commonly, such heat exchanger designs include a distributor that splits a flow of refrigerant among the various refrigerant circuits of the heat exchanger. In existing designs, however, the distributor and distribution tubes that split the refrigerant into individual refrigerant circuits typically contributes significantly to pressure drop for the refrigerant. This can be particularly true during reverse flow operation of the heat exchanger. This can result in significant degradation of the heat pump system's performance.

What is needed, therefore, are improved systems for distributing refrigerant to multiple refrigerant flow paths in a heat exchanger, while decreasing any pressure drop for the refrigerant.

SUMMARY

This and other problems are be addressed by the technologies described herein. Examples of the present disclosure relate generally to distributor systems for heat exchangers, and particularly to distributor systems for heat exchangers in a reversible vapor-compression system (e.g., a heat pump).

This disclosed technology includes a header tube assembly including an outer tube, an inner tube, and a flow valve. The outer tube can have an open end and a closed end. The outer tube can include a plurality of outer apertures extending through a sidewall of the outer tube, and each of the plurality of outer apertures can be configured to direct a flow of refrigerant between an internal volume of the outer tube and a corresponding refrigerant flow path of a heat exchanger. The inner tube can be located within the internal volume of the outer tube. The inner tube can have (i) an open end proximate the open end of the outer tube, (ii) a closed end proximate the closed end of the outer tube, and (iii) an external diameter that is less than an internal diameter of the outer tube such that a gap exists between the inner tube and the outer tube. The inner tube can include a plurality of inner apertures extending through a sidewall of the inner tube, and each of the plurality of inner apertures can be configured to permit refrigerant to flow therethrough between an internal volume of the inner tube and the gap. The flow valve can be disposed within the outer tube at a location between the open end of the inner tube and the open end of the outer tube. The flow valve can be configured to slide between a first position proximate the open end of the inner tube and a second position that is nearer the open end of the outer tube than the first position. The flow valve can have an aperture extending therethrough, and the aperture of the flow valve can be at least partially aligned with the open end of the outer tube and the open end of the inner tube.

The flow valve can be configured to move in a first direction extending from the open end of the outer tube to the closed end of the outer tube and a second direction extending from the closed end of the outer tube to the open end of the outer tube. The flow valve can be configured to move in the first direction to a semi-closed state in response to a flow of refrigerant flowing through the header tube assembly in the first direction. The semi-closed state can be configured to (i) permit the flow of refrigerant to flow through the aperture of the flow valve and into the internal volume of the inner tube and (ii) prevent the flow of refrigerant between the open end of the outer tube and the gap. The flow valve can be configured to move in the second direction to an open state in response to a flow of refrigerant flowing through the header tube assembly in the second direction. The open state can be configured to permit the flow of refrigerant to flow through the gap to the open end of the outer tube and through the aperture of the flow valve.

The header tube assembly can include a nozzle at the open end of the inner tube.

At least one of the plurality of outer apertures can be located on a first side of the header tube assembly, and at least one of the plurality of outer apertures can be located on a second side of the header tube assembly.

The outer tube can have a gradually changing diameter along a length of the header tube assembly. The outer tube can have a tapered wall that tapers inwardly as the tapered wall extends in a direction extending from the open end of the outer tube to the closed end of the outer tube. The inner tube can have a tapered wall that tapers inwardly as the tapered wall extends in the direction extending from the open end of the outer tube to the closed end of the outer tube.

The diameters of the plurality of outer apertures can gradually increase along a length of outer tube from the open end of the outer tube to the closed end of the outer tube. The diameters of the plurality of outer apertures can gradually decrease along a length of outer tube from the open end of the outer tube to the closed end of the outer tube.

The diameters of the plurality of inner apertures can gradually increase along a length of inner tube from the open end of the inner tube to the closed end of the inner tube. The diameters of the plurality of inner apertures can gradually decrease along a length of inner tube from the open end of the inner tube to the closed end of the inner tube.

The diameter of each of the plurality of inner apertures can be less than a diameter of a corresponding one of the plurality of outer apertures. The diameter of each of the plurality of inner apertures can be greater than a diameter of a corresponding one of the plurality of outer apertures.

A distance between adjacent pairs of the outer apertures can gradually change along a length of the header tube assembly. A distance between adjacent pairs of the inner apertures can gradually change along a length of the header tube assembly.

The disclosed technology includes a header tube assembly including a longitudinal housing having an open end and a closed end. The housing can include a plurality of apertures extending through a sidewall of the housing, and each of the plurality of apertures can be configured to direct a flow of refrigerant between an internal volume of the housing and a corresponding refrigerant flow path of a heat exchanger. The header tube assembly can include a flexible check valve disposed at the open end of the housing. The flexible check valve can have an opening that is configured to transition between a first state having a first cross-sectional area and a second state having a second cross-sectional area that is greater than the first cross-sectional area. The flexible check valve can be configured to transition to the second state when a flow of refrigerant flows through the housing in a direction extending from the closed end to the open end. The flexible check valve can be configured to resist deformation when the flexible check valve is in the first state, which can correspond to the flow of refrigerant flowing through the housing in a direction extending from the open end to the closed end.

The disclosed technology includes a header tube assembly including a longitudinal housing having an open end and a closed end. The housing can include a plurality of apertures extending through a sidewall of the housing, and each of the plurality of apertures being configured to direct a flow of refrigerant between an internal volume of the housing and a corresponding refrigerant flow path of a heat exchanger. At least one of the sidewalls of the housing can be a tapered wall that tapers inwardly as the tapered wall extends in a direction extending from the open end to the closed end.

BRIEF DESCRIPTION OF THE DRAWINGS

Reference will now be made to the accompanying drawings, which are not necessarily drawn to scale. The drawings are incorporated into and constitute a portion of this disclosure, illustrating various implementations and aspects of the disclosed technology. Together with the description, the drawings serve to explain the principles of the disclosed technology.

DETAILED DESCRIPTION

Figure 1:
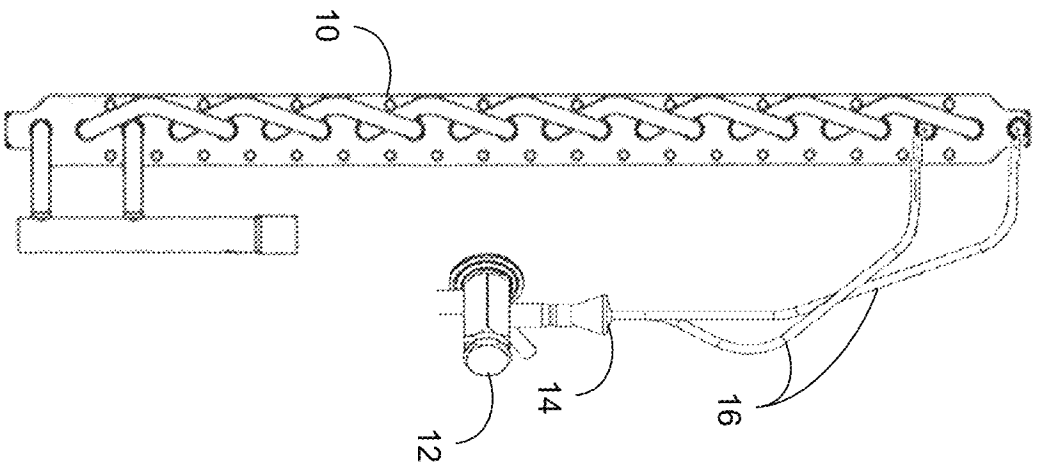
FIG. 1 PRIOR ART
FIG. 1 illustrates an existing multi-path heat exchanger.

Throughout this disclosure, systems and methods are described with respect to distributing refrigerant among a plurality of refrigerant flow paths in a heat exchanger while reducing or minimizing any pressure drop associated with refrigerant flowing through the refrigerant flow paths. For ease of discussion, the disclosed technology is discussed herein with reference to heat pumps configured to heat and/or cool a conditioned space (i.e., air-to-refrigerant heat pumps). The disclosed technology is so not limited and can be used in residential or commercial air conditioners and heat pumps (whether split or packaged), heat pump water heaters (e.g., for domestic use water), heat pump pool heaters, commercial refrigeration systems, or any other heat pump systems.

Some implementations of the disclosed technology will be described more fully with reference to the accompanying drawings. This disclosed technology may, however, be embodied in many different forms and should not be construed as limited to the implementations set forth herein. The components described hereinafter as making up various elements of the disclosed technology are intended to be illustrative and not restrictive. Indeed, it is to be understood that other examples are contemplated. Many suitable components that would perform the same or similar functions as components described herein are intended to be embraced within the scope of the disclosed devices and methods. Such other components not described herein may include, but are not limited to, for example, components developed after development of the disclosed technology.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

Unless otherwise specified, all ranges disclosed herein are inclusive of stated end points, as well as all intermediate values. By way of example, a range described as being "from approximately 2 to approximately 4" includes the values 2 and 4 and all intermediate values within the range. Likewise, the expression that a property "can be in a range from approximately 2 to approximately 4" (or "can be in a range from 2 to 4") means that the property can be approximately 2, can be approximately 4, or can be any value therebetween. Further, the expression that a property "can be between approximately 2 and approximately 4" is also inclusive of the endpoints, meaning that the property can be approximately 2, can be approximately 4, or can be any value therebetween.

It is to be understood that the mention of one or more method steps does not preclude the presence of additional method steps or intervening method steps between those steps expressly identified. Similarly, it is also to be understood that the mention of one or more components in a device or system does not preclude the presence of additional components or intervening components between those components expressly identified.

As used herein, unless otherwise specified, the use of the ordinal adjectives "first," "second," "third," etc., to describe a common object, merely indicate that different instances of like objects are being referred to and are not intended to imply that the objects so described must be in a given sequence, either temporally, spatially, in ranking, or in any other manner.

Although the disclosed technology may be described herein with respect to various systems and methods, it is contemplated that embodiments or implementations of the disclosed technology with identical or substantially similar features may alternatively be implemented as methods or systems. For example, any aspects, elements, features, or the like described herein with respect to a method can be equally attributable to a system. As another example, any aspects, elements, features, or the like described herein with respect to a system can be equally attributable to a method.

Reference will now be made in detail to examples of the disclosed technology that are illustrated in the accompanying drawings and disclosed herein. Wherever convenient, the same reference numbers will be used throughout the drawings to refer to the same or like parts.

In FIG. 1, an example of an existing multi-path heat exchanger 10 is illustrated. The heat exchanger 10 can be a fin-and-tube heat exchanger. Alternatively, the heat exchanger 10 can be any other type of heat exchanger. The example multi-path heat exchanger 10 can be an outdoor evaporator used for space heating, for example. As shown, refrigerant flows through a valve assembly 12 including a thermal expansion valve (TXV) and to a distributor body 14, which splits the flow of refrigerant into multiple refrigerant flow paths each flowing through a dedicated distributor tube 16 to a corresponding refrigerant circuit of the heat exchanger 10. In reversible systems, the valve assembly 12 can include a check valve. For example, when the heat pump is in space heating mode and the outdoor heat exchanger 10 is operating as an evaporator, the valve assembly 12 can be configured to direct refrigerant through the TXV of the valve assembly 12. Conversely, when the heat pump is in space cooling mode and the outdoor heat exchanger 10 is operating as a condenser, the valve assembly 12 can be configured to direct refrigerant through the check valve of the valve assembly 12. As described herein, however, existing designs such as the one depicted in FIG. 1 can present an undesirable pressure drop, particularly during reverse flow operation (e.g., when an outdoor heat exchanger functions as an evaporator to accept heat from ambient air and transport the heat to the indoor heat exchanger, which is functioning as a condenser). For example, it has been determined that, when at least some existing heat pump systems are running in cooling mode (in which the outdoor heat exchanger 10 is functioning as a condenser and the valve assembly 12 acts as a check valve), the pressure drop across the distributor tubes 16 and distributor body 14 together was more than 1.5 times the pressure drop across the heat exchanger 10 itself, and the pressure drop across the distributor tubes 16 and distributor body 14 continued to increase with increases in mass flow rate or capacity of the heat pump.

Figure 2:
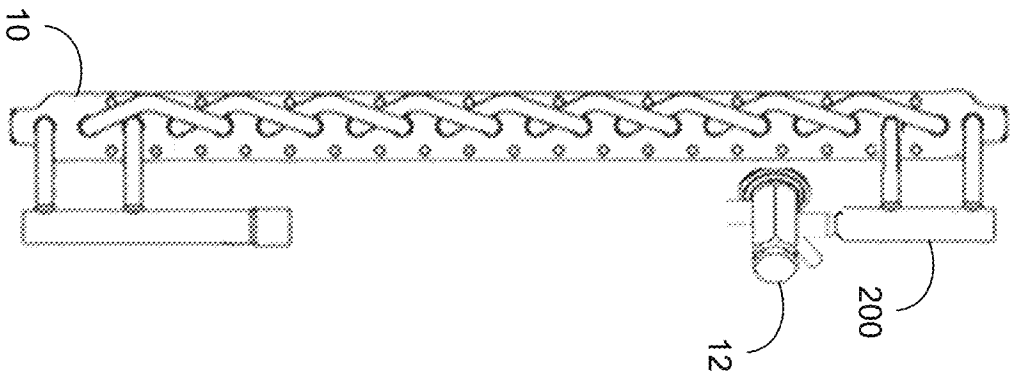
FIG. 2 illustrates a multi-path heat exchanger including an example header tube assembly, in accordance with the disclosed technology.

Referring now to FIG. 2, the disclosed technology includes a multi-path heat exchanger 10 and a valve assembly 12, which can include a thermal expansion valve (TXV) and a check valve. For ease of discussion, the multi-path heat exchanger 10 is referenced as being an outdoor heat exchanger in a reversible heat pump for space heating/cooling. Thus, the valve assembly 12 is configured to direct refrigerant through the TXV when the heat pump is in heating mode and the heat exchanger is functioning as an evaporator, and the valve assembly 12 is configured to direct refrigerant through the check valve when the heat pump is in cooling mode, in which refrigerant is directed through the heat pump in reverse flow and the heat exchanger 10 is functioning as a condenser. The disclosed technology is not so limited, however. For example, the heat exchanger 10 could alternatively be an indoor heat exchanger, in which case the valve assembly 12 can be configured to direct refrigerant through the check valve of the valve assembly 12 when the heat pump is in heating mode and the indoor heat exchanger is functioning as a condenser, and the valve assembly 12 can be configured to direct refrigerant through the TXV of the valve assembly 12 when the heat pump is in cooling mode and the indoor heat exchanger is functioning as an evaporator. As will be described more fully herein, the distributor tubes 16 and distributor body 14 of previous systems can be replaced with a header tube assembly 200 having a comparatively large diameter and/or short length. The header tube assembly 200 can be located between the valve assembly 12 and the heat exchanger 10 and can reduce the high magnitudes of pressure drop as compared to that caused by existing distributor designs.

Figure 3A:
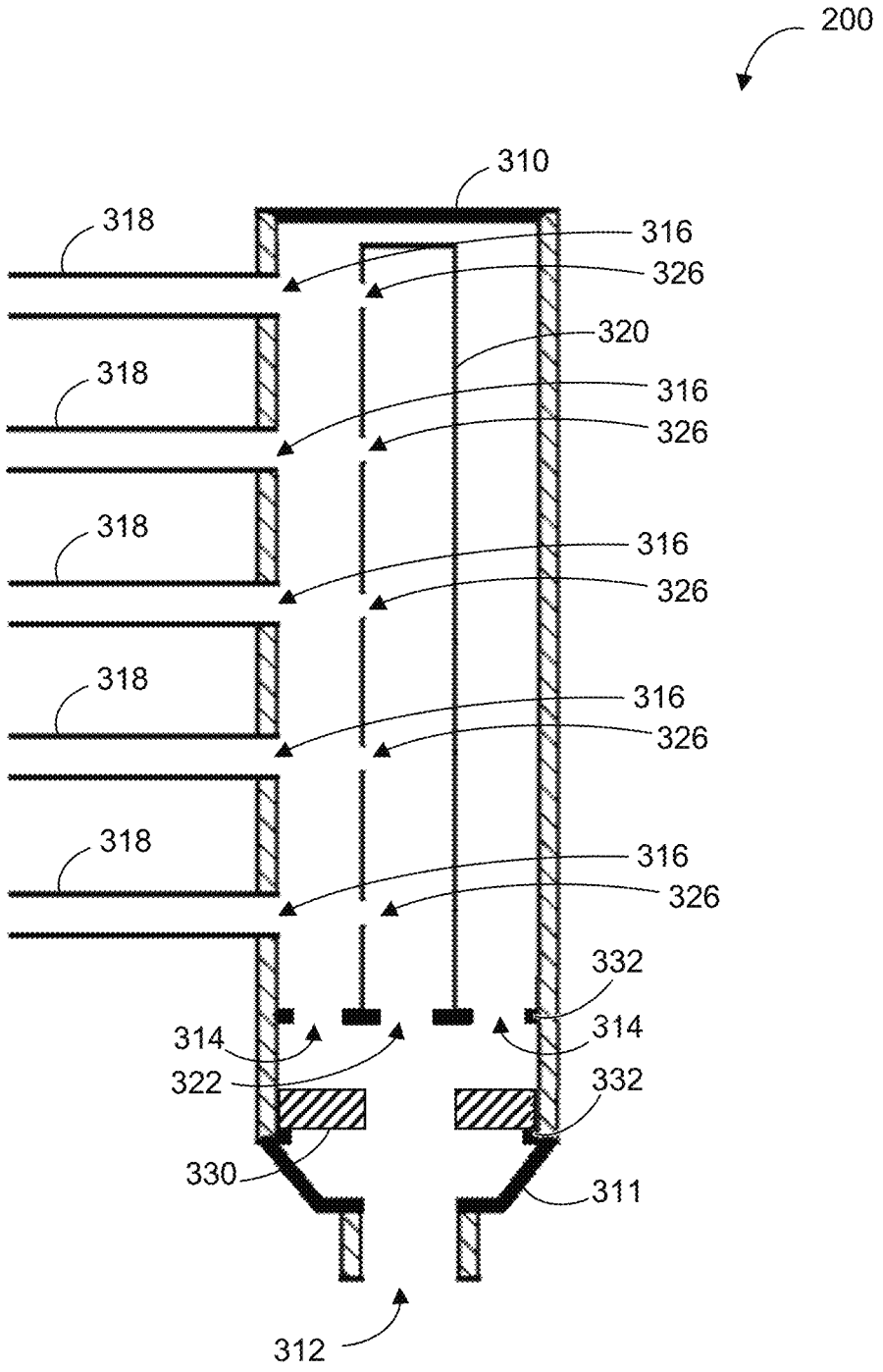
FIGS. 3A-3C illustrate a cross-sectional view of an example header tube assembly, with FIG. 3B depicting operation with refrigerant flowing therethrough in a first direction and FIG. 3C depicting operation with refrigerant flowing therethrough in a second direction, in accordance with the disclosed technology.

As illustrated in FIG. 3A, the header tube assembly 200 can include an outer tube 310 and an inner tube 320. The inner tube 320 can be suspended within the outer tube 310. Each of the outer tube 310 and the inner tube 320 can be closed at a common axial end (shown as the top ends of the respective tubes 310, 320) and can be open at a common axial end (shown as the bottom ends of the respective tubes 310, 320). Stated otherwise, the outer tube 310 can include an opening 312 at one end that is configured to permit refrigerant to flow out of or into the header tube assembly 200 (e.g., to/from the valve assembly 12), and the open end of the inner tube 320 can define a nozzle 322. The nozzle 322 can be substantially axially aligned with the opening 312. That is, the inner tube 320 can be in substantial axial alignment with the outer tube 310.

The opening 312 can have a diameter that is less than the outer diameter of the outer tube 310, and the outer tube 310 can optionally include an angled transition wall 311 that angles outwardly from or near the opening 312 and to the outer diameter of the outer tube 310. The inner tube 320 can have an outer diameter that is less than an inner diameter of the outer tube 310 such that a gap exists between the exterior surface of the inner tube 320 and the interior surface of the outer tube 310. The gap between the exterior surface of the inner tube 320 and the interior surface of the outer tube 310 can be generally annular when the outer tube 310 has a generally cylindrical shape, the inner tube 320 has a generally cylindrical shape, and the inner tube 320 is generally coaxial with the outer tube 310. That is to say, the cross-sections of the inner tube 320 and the outer tube 310 can be circular. While the cross-section of the inner tube 320 and the outer tube 310 can have the same shape, they can alternatively have different shapes. As non-limiting examples, the cross-section of the inner tube 320 and/or the cross-section of the outer tube 310 can be a circle, an ellipse, an oval, or any other shape (e.g., a polygonal shape).

The header tube assembly 200 can include a flow valve 330. The flow valve 330 can be located inside the outer tube 310 at a location that is between the open end of the inner tube 320 and the open end of the outer tube 310. The header tube assembly 200 can include one or more steps 332 to prevent excess movement of the flow valve 330 and/or to maintain proper alignment of the flow valve. For example, a step 332 (e.g., an upper step) can be located at or near the entrance to the nozzle 322 (and/or at or near the open end of the inner tube 310), and/or a step 332 (e.g., a lower step) can be located a distance below the entrance to the nozzle 322 (and/or a distance below the open end of the inner tube 310). The lower step can be located, for example, at a location above the transition wall 311. Alternatively, the lower step can be omitted, and the transition wall 311 can function as a lower step.

The outer tube 310 can include a plurality of outer holes, or apertures, 316 along the sidewall of the outer tube 310. Likewise, the inner tube 320 can include a plurality of inner holes, or apertures, 326 along the sidewall of the inner tube 320. Each inner hole 326 can be substantially aligned with a corresponding outer hole 316. Alternatively, the outer and inner tubes can include different numbers of holes and/or the holes of the outer and inner tubes may not align with one another (i.e., can be offset from one another). Each inner hole 326 can directly fluidly connect the internal volume of the inner tube 320 with the gap 314. There can be any number of each kind of hole 316, 326, such as two inner holes 326 and two outer holes 316, three inner holes 326 and three outer holes 316, five inner holes 326 and five outer holes 316, nine inner holes 326 and nine outer holes 316, or fifteen inner holes 326 and fifteen outer holes 316, as non-limiting examples.

The diameter of each inner hole 326 can be equal or approximately equal. Alternatively, one, some, or all of the inner holes 326 can have a different diameter. For example, the diameter of the inner holes 326 can incrementally increase (e.g., linearly increase) from the open end of the inner tube 320 to the closed end of the inner tube 320. As another example, the diameter of the inner holes 326 can incrementally decrease (e.g., linearly decrease) from the open end of the inner tube 320 to the closed end of the inner tube 320. Similarly, the diameter of each outer hole 316 can be equal or approximately equal. Alternatively, one, some, or all of the outer holes 316 can have a different diameter. For example, the diameter of the outer holes 316 can incrementally increase (e.g., linearly increase) from the open end of the outer tube 310 to the closed end of the outer tube 310. As another example, the diameter of the outer holes 316 can incrementally decrease (e.g., linearly decrease) from the open end of the outer tube 310 to the closed end of the outer tube 310. As will be appreciated, varying the diameters of the holes 316, 326 can cause the various holes 316, 326 to have different k-factor values. Stated otherwise, varying the diameters of the holes 316, 326 can cause different holes to have different pressure drops. This can further assist in uniform flow distribution of refrigerant in the various refrigerant circuits of the heat exchanger 10.

The diameter of each inner hole 326 can be equal or approximately equal to the diameter of each corresponding outer hole 316. Alternatively, one, some, or all of the inner holes 326 can have a diameter that is different from the diameter of the corresponding outer hole 316. For example, one, some, or all of the inner holes 326 can have a diameter that is greater than the diameter of the corresponding outer hole 316. Alternatively or in addition, one, some, or all of the inner holes 326 can have a diameter that is less than the diameter of the corresponding outer hole 316.

The distance between adjacent holes 316, 326 of the outer tube 310 and/or of the inner tube 320 can be equal along the length of the header tube assembly 200. Alternatively, the distance between adjacent holes 316, 326 can change along the length of the header tube assembly. For example, the distance between adjacent holes 316, 326 can be incrementally increased from the open end of the header tube assembly to the closed end of the header tube assembly 200. Alternatively, the distance between adjacent holes 316, 326 can be incrementally decreased from the open end of the header tube assembly to the closed end of the header tube assembly 200.

The header tube assembly 200 can include a plurality of conduits 318 attached to the sidewall of the outer tube 310. The conduits 318 can be rigid, or the conduits can be flexible. Each conduit 318 can align with a corresponding outer hole 316 and can optionally substantially align with a corresponding inner hole 326. Each conduit 318 can be configured to attach or connect to a corresponding refrigerant flow path of the heat exchanger 10. One, some, or all of the conduits 318 can have an inner diameter that is approximately equal to the inner diameter of the corresponding refrigerant flow path of the heat exchanger 10 (e.g., approximately ¼-inch, approximately 3/16-inch). Alternatively or in addition, one, some, or all of the conduits 318 can have an inner diameter that is less than the inner diameter of the corresponding refrigerant flow path of the heat exchanger 10 (e.g., less than approximately ¼-inch, less than approximately 3/16-inch).

Dimensions (e.g., length, inner diameter) of the outer tube 310 and the inner tube 320 can be varied to accommodate any number of refrigerant circuits of the heat exchanger 10. Generally speaking, as the number of the refrigerant circuits of the heat exchanger 10 increases, the required volume of the header tube assembly 200 also increases. Thus, the length and/or inner diameter of the outer tube 310 and/or inner tube 320 can be increased or decreased according to the number of refrigerant paths to be accommodated by the header tube assembly 200.

The outer tube 310, inner tube 320, conduits 318, flow valve 330, and/or steps 332 can be fabricated with and/or include any material compatible with the refrigerant used, such as stainless steel, copper, aluminum, PTFE, or the like.

As discussed herein, the disclosed technology can reduce the pressure drop for refrigerant flowing in a first direction (e.g., from the closed end of the header tube assembly 200 to the open end of the header tube assembly 200), while maintaining or increasing the pressure drop for refrigerant flowing in a second direction that is opposite from the first direction (e.g., from the open end of the header tube assembly 200 to the closed end of the header tube assembly 200). The maintained or increased pressure drop in the second direction can be necessary for completion of the vapor-compression cycle and/or can help to reduce the requisite size of the TXV.

Figure 3B:
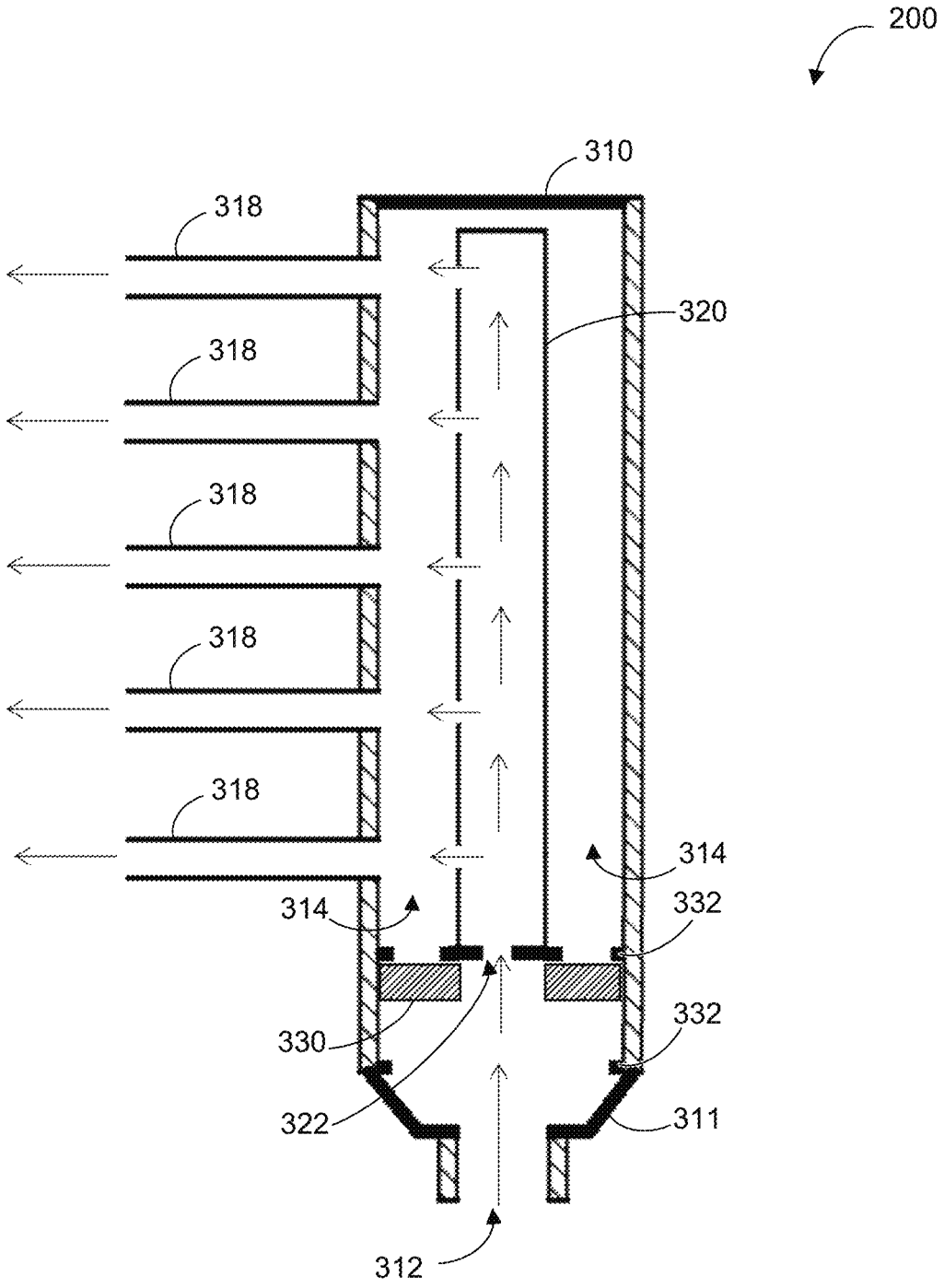
Figure 3C:
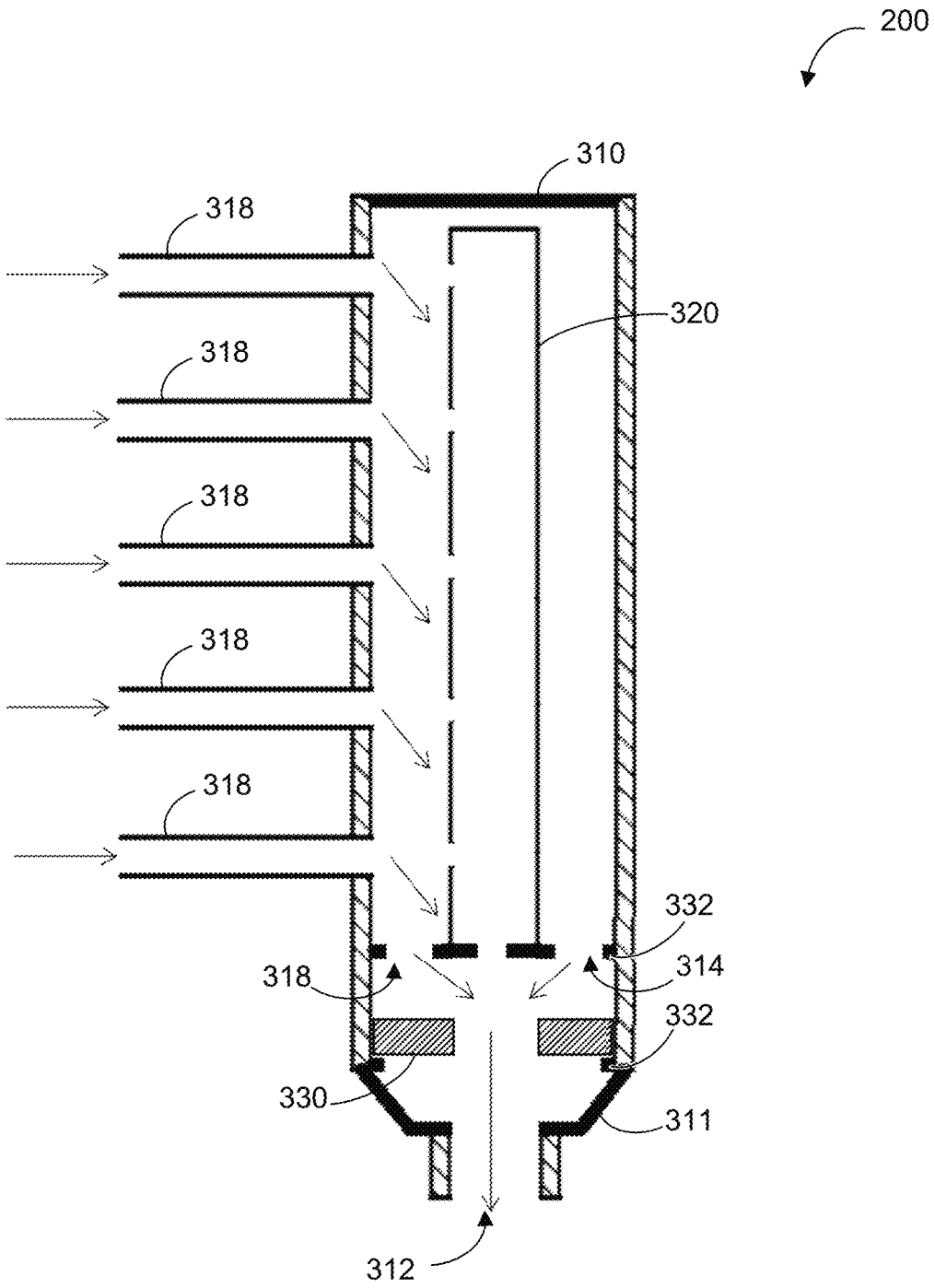

Referring now to FIGS. 3B and 3C, operation of the header tube assembly 200 is discussed. For clarity of illustration, some elements visible in FIGS. 3B and 3C are not labeled.

As shown in FIG. 3B, when the heat pump is operating in heating mode, the example heat exchanger 10 connected to the illustrated header tube assembly 200 can function as an evaporator, and refrigerant can flow into the header tube assembly 200 through the opening 312. The flow of refrigerant can push the flow valve 330 against the upper step 332, sealing or substantially blocking the refrigerant from flowing through the opening 312 and directly into the gap 314 (i.e., the flow of refrigerant can push the flow valve 330 into a semi-closed state). That is to say, when the flow valve 330 is in a semi-closed state, the flow valve 330 can prevent the refrigerant from flowing between the open end of the outer tube 310 and the gap 314 (i.e., without first flowing through the inner tube 320). Thus, the cross-sectional area through which the refrigerant can flow is restricted to that of the nozzle 322 and/or the internal diameter of the inner tube 320 (e.g., if there is no nozzle 322). This can help mix the vapor phase portion and liquid phase portion of refrigerant in the header tube assembly 200, which can help prevent stratification of the vapor and liquid refrigerant due to gravity. The mixed refrigerant can experience some pressure drop along the length of the header tube assembly 200. The mixing of the refrigerant and/or the positioning of the inner holes 326 along the length of the inner tube 320 (and/or of the outer holes 316 along the length of the outer tube 310) can help evenly distribute refrigerant to the various refrigerant circuits via the inner holes 326, the outer holes 316, and the conduits 318. Moreover, this flow restriction can help to make bubbles in the two-phase refrigerant flowing through the header tube assembly 200 and/or can help to evenly distribute refrigerant among the various conduits 318. This can also increase the pressure drop, which can enable the size of the TXV of the valve assembly 12 to be reduced.

As shown in FIG. 3C, when the heat pump is operating in cooling mode, the example heat exchanger 10 connected to the illustrated header tube assembly 200 can function as a condenser, and refrigerant can flow from the heat exchanger 10 into the header tube assembly 200 through the conduits 318. As will be appreciated, the refrigerant flowing into the header tube assembly 200 from the heat exchanger can be single-phase liquid refrigerant or two-phase refrigerant, depending on which heat exchanger 10 the header tube assembly 200 is attached to (e.g., indoor heat exchanger or outdoor heat exchanger). Due to the large increase in diameter when traversing through the conduits 318 and outer holes 316 into the internal volume of the outer tube 310, the pressure drop of the refrigerant can be decreased. The flow of refrigerant can push the flow valve 330 toward the opening 312 (e.g., against the lower step 332, against the transition wall 311) such that the flow valve 330 can be in an open state, which can result in the refrigerant flowing from the outer holes 316, through the gap 314, and out of the header tube assembly 200 via the opening 312. Depending on operating conditions, some refrigerant can potentially flow from the outer holes 316, through the inner holes 326, and through the inner tube 320 to the opening 312.

Figure 4:
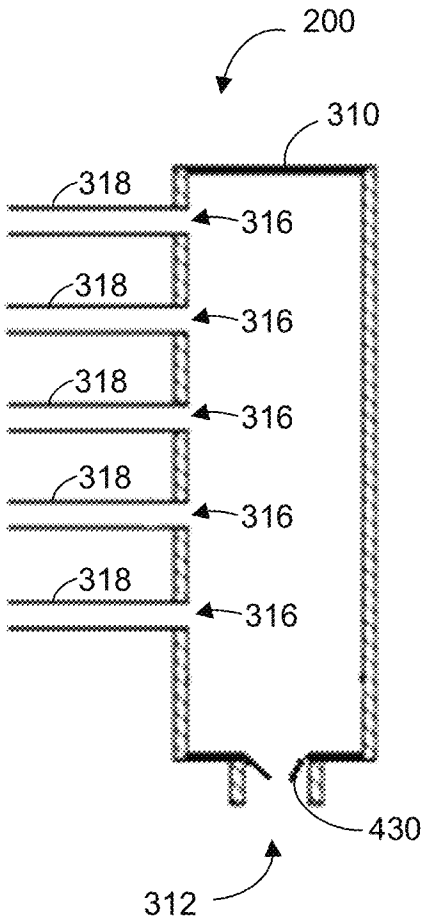
FIG. 4 illustrates a cross-sectional view of an example header tube assembly, in accordance with the disclosed technology.

Referring to FIG. 4, the header tube assembly 200 can include a flexible flow valve 430, rather than the flow valve 330. The flexible flow valve 430 can have an opening that is configured to transition between a first state having a first cross-sectional area and a second state having a second cross-sectional area that is greater than the first cross-sectional area. Alternatively or in addition, the header tube assembly 200 can omit the inner tube 220 such that the header tube assembly includes the outer tube 310, the outer holes 316, the conduits 318, and the flexible flow valve 430.

When the heat pump is operating in heating mode, the example heat exchanger 10 connected to the illustrated header tube assembly 200 can function as an evaporator, and refrigerant can flow into the header tube assembly 200 through the opening 312. The flexible flow valve 430 can configured to be in the first state when the refrigerant is flowing through the header tube assembly 200 in a direction extending from the open end of the header tube assembly 200 to the closed end of the header tube assembly 200 (e.g., when the heat pump is operating in heating mode). Stated otherwise, when the refrigerant is flowing into the header tube assembly 200 via the opening 312, the flexible flow valve 430 can be configured to resist deformation and/or deform a small amount, such that the opening is a first diameter. This can help mix and/or evenly distribute refrigerant to the various refrigerant circuits via the inner holes 326, the outer holes 316, and the conduits 318, as discussed herein. Moreover, this flow restriction can help to make bubbles in the two-phase refrigerant and/or can help to evenly distribute refrigerant among the various conduits 318.

The flexible flow valve 430 can be configured to transition to the second state when the refrigerant is flowing through the header tube assembly 200 in a direction extending from the closed end of the header tube assembly 200 to the open end of the header tube assembly 200 (e.g., when the heat pump is operating in cooling mode). That is to say that, when the heat pump is operating in cooling mode, the example heat exchanger 10 connected to the illustrated header tube assembly 200 can function as a condenser, and refrigerant can flow from the heat exchanger 10 into the header tube assembly 200 through the conduits 318. Due to the large increase in diameter when traversing through the conduits 318 and outer holes 316 into the internal volume of the outer tube 310, the pressure drop of the refrigerant can be decreased. The flow of refrigerant can push the flexible flow valve 430 toward the opening 312, thereby causing the flexible flow valve 430 to deform and increasing the diameter of the opening to a second diameter that is greater than the first diameter. This, too, can help decrease the pressure drop of the refrigerant through the header tube assembly 200.

Figure 6:
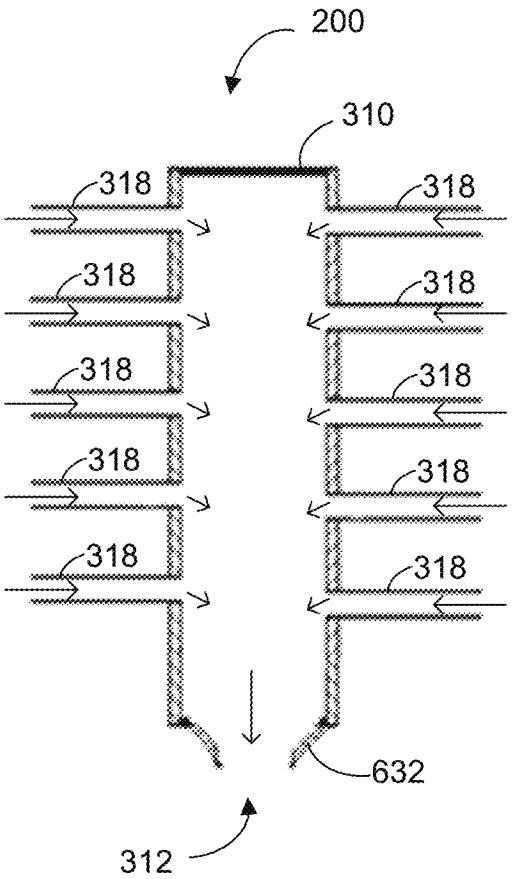
FIG. 6 illustrates a cross-sectional view of an example header tube assembly, in accordance with the disclosed technology.
Figure 5:
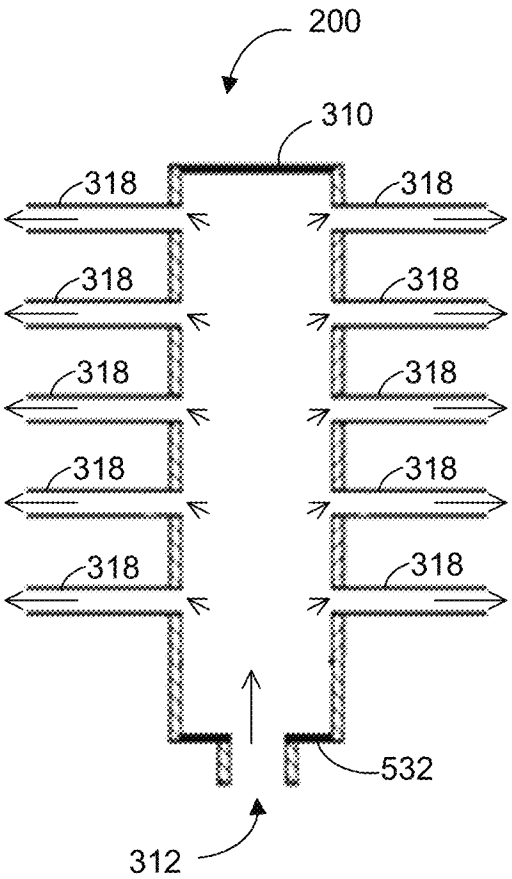
FIG. 5 illustrates a cross-sectional view of an example header tube assembly, in accordance with the disclosed technology.

Referring now to FIG. 5, the open end of the header tube assembly 200 can have an opening 312 having a first diameter, and moving in a direction from the open end to the closed end, the internal diameter of the heater tube assembly 200 can abruptly change to a second diameter (e.g., the internal diameter of the outer tube 310) that is greater than the first diameter such that a step 532 is formed. Alternatively, as shown in FIG. 6, the diameter of the heater tube assembly 200 can gradually increase from the first diameter at the opening 312 to a second diameter that is greater than the first diameter. As an example, the second diameter can be the internal diameter of the outer tube 310. Such a gradual change in diameter can be provided by a graduated wall 632, which can be linearly angled or non-linear, such as a quadratic curve, a parabolic curve, or any other desired graduation. The graduated wall 632 can include the angled transition wall 311, for example. While the header tube assembly 200 is illustrated in FIGS. 5 and 6 without showing the inner tube 320, it is contemplated that the header tube assembly 200 can include the step 532 and/or the graduated wall 632 with or without the inner tube 320.

The conduits 318 can be connected to the outer tube 310 on a single side of the outer tube 310 (see, e.g., FIG. 4). Alternatively, the conduits 318 can be connected to the outer tube 310 on a plurality of sides of the outer tube 310. If the conduits 318 are connected to the outer tube 310 on multiple sides of the outer tube 310, opposite conduits 318 can be connected on the same plane (see e.g., FIG. 5) and/or at the same location along the length of the outer tube 310. Alternatively, if the conduits 318 are connected to the outer tube 310 on multiple sides of the outer tube 310, opposite conduits 318 can be connected on different planes (see e.g., FIG. 6) and/or at different locations along the length of the outer tube 310.

Figure 7A:
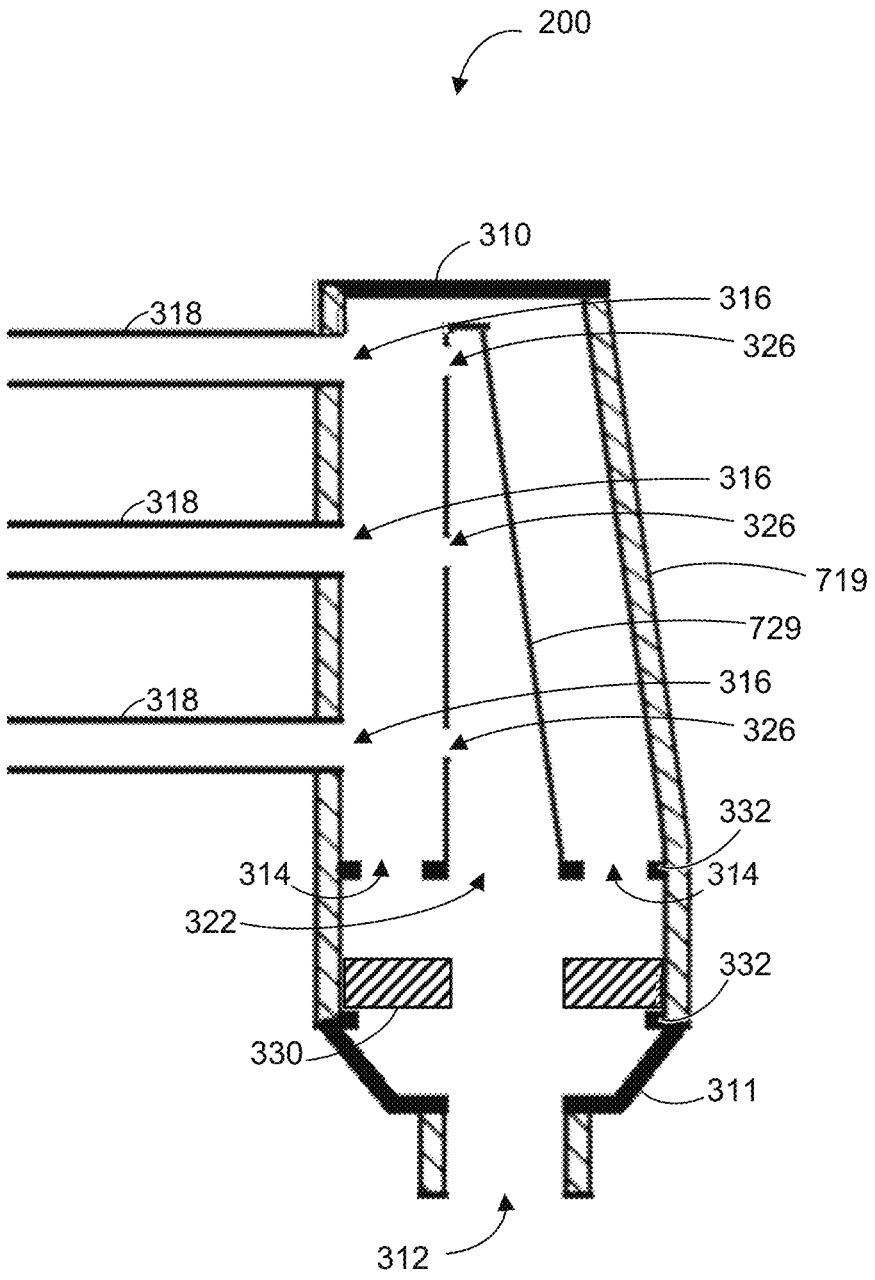
FIGS. 7A-7C illustrate a cross-sectional view of an example header tube assembly, with FIG. 7B depicting operation with refrigerant flowing therethrough in a first direction and FIG. 7C depicting operation with refrigerant flowing therethrough in a second direction, in accordance with the disclosed technology.
Figure 7B:
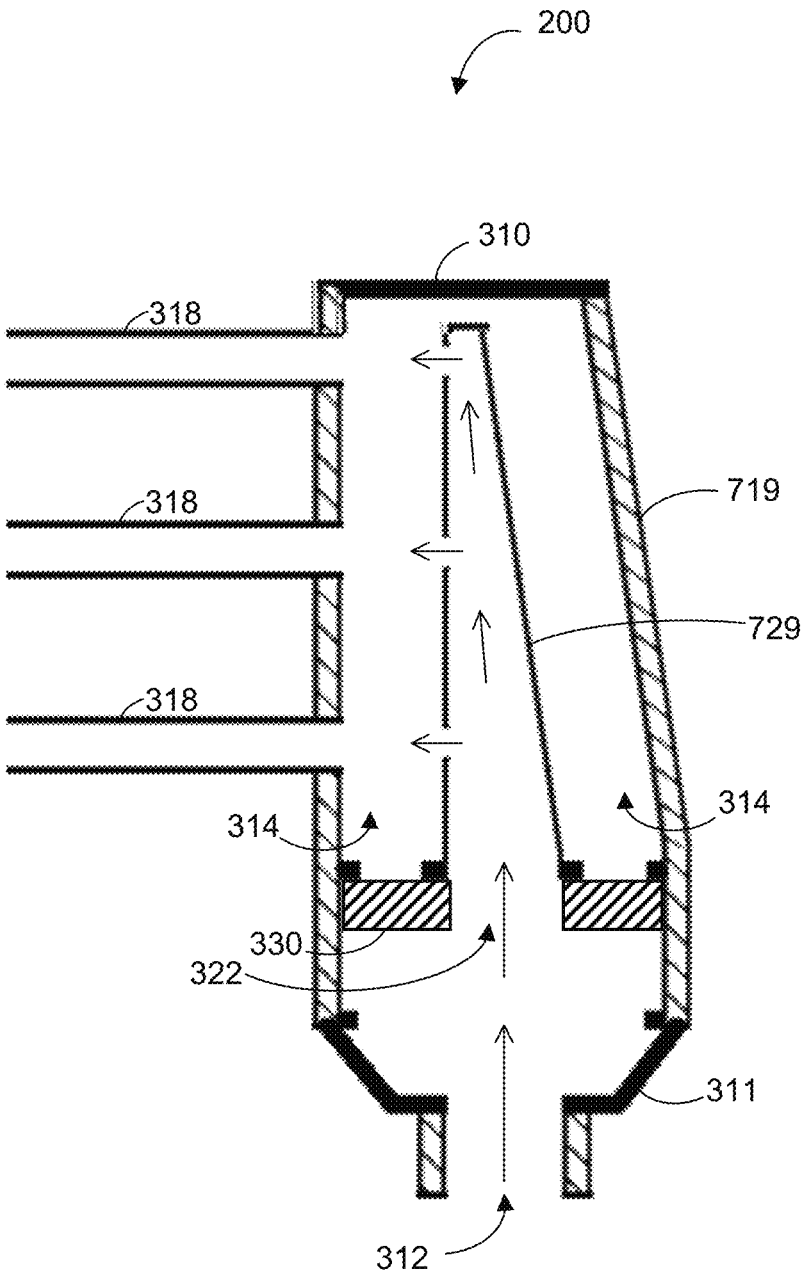
Figure 7C:
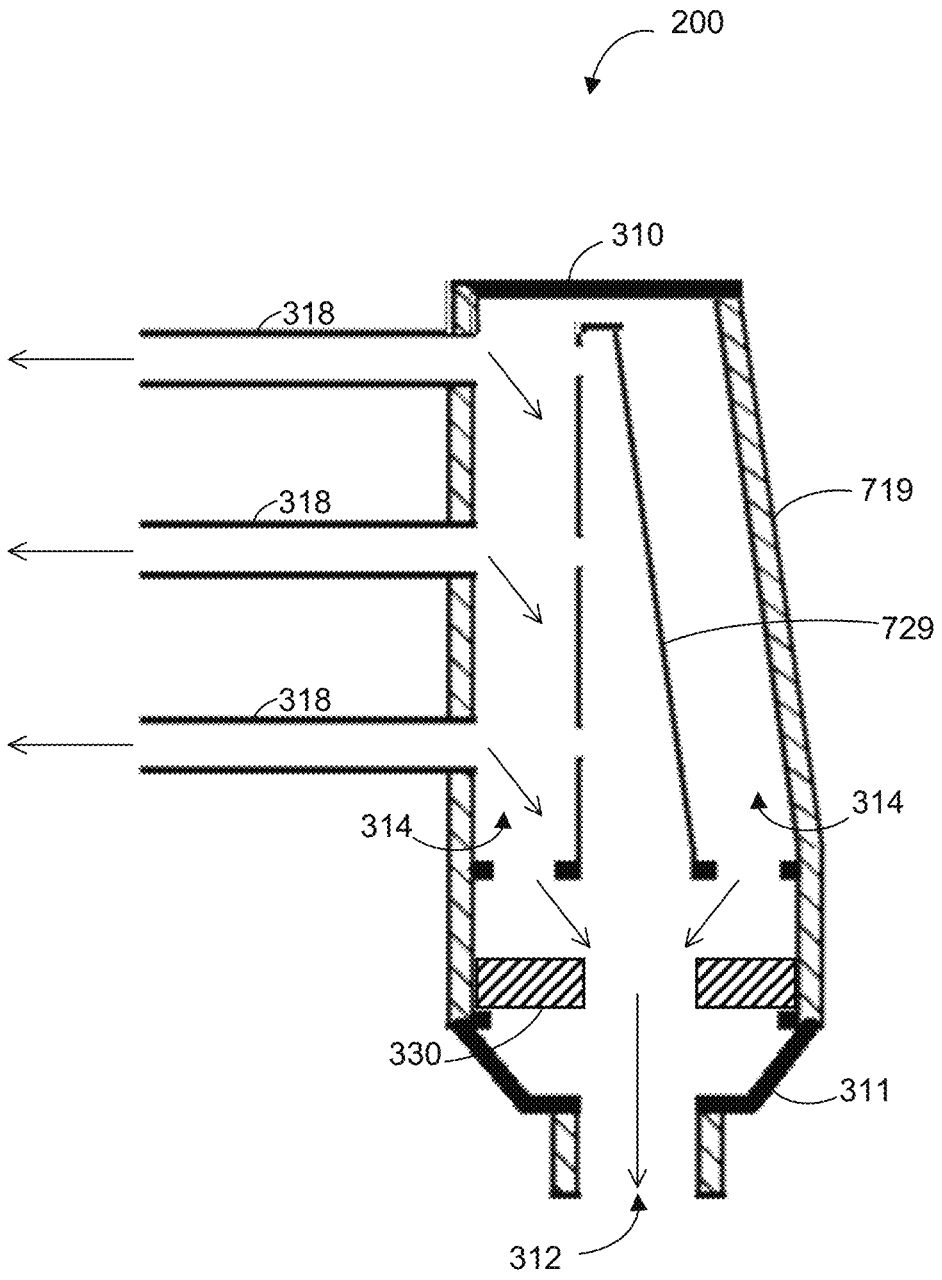

Referring now to FIGS. 7A-7C, the header tube assembly 200 can have non-parallel side walls. Stated otherwise, the header tube assembly 200 can have an internal diameter that gradually changes over the length of the header tube assembly 200. For example, the sidewall of at least one side of the outer tube 310 can be tilted or angled with respect to the sidewall of at least one other side of the outer tube 310. Stated otherwise, the header tube assembly 200 can include at least one outer tapered sidewall 719. The taper of the tapered sidewall 719 can be linear (e.g., as illustrated), or the taper can be non-linear, such as a quadratic curve, a parabolic curve, or any other desired taper. The outer tapered sidewall(s) 719 can taper inwardly (e.g., radially inward) from the open end to the closed end of the outer tube 310. Alternatively or in addition, the inner tube 320 can include at least one inner tapered sidewall 729, and the inner tapered sidewall(s) 729 can taper inwardly (e.g., radially inward) from the open end to the closed end of the outer tube 320. Alternatively or in addition, at least one of the outer tapered sidewall(s) 719 or the inner tapered sidewall(s) 729 can taper inwardly from the closed end of the open end of the respective tube 310, 320.

The gradual change in the diameter can help maintain consistency of the refrigerant flow mass flux at any location along the length of the header tube assembly 200. Thus, during heating mode, as in FIG. 7B, the header tube assembly 200 can provide substantially uniform refrigerant flow distribution to all refrigerant circuits in the heat exchanger 10. And during cooling mode, as in FIG. 7C, the header tube assembly 200 provides an increasing inner cross-sectional area, and thus an increasing inner volume, to collect refrigerant coming from the successive refrigerant circuits. This can help avoid localized increases in pressure at the opening 312. In other words, the gradually change in internal diameter can result in a decrease in the pressure due to the increase in the area at the exit of the header tube assembly 200 (as compared to an expected increase in pressure for a uniform diameter tube due to the collection of refrigerant from all refrigerant circuits).

Regardless of whether the header tube assembly 200 includes parallel walls (e.g., a uniform diameter, such as in FIGS. 3A-3C) or non-parallel walls (e.g., a variable diameter, such as in FIGS. 7A-7C), operation of the header tube assembly 200 can be substantially the same, as described herein.

Figure 8:
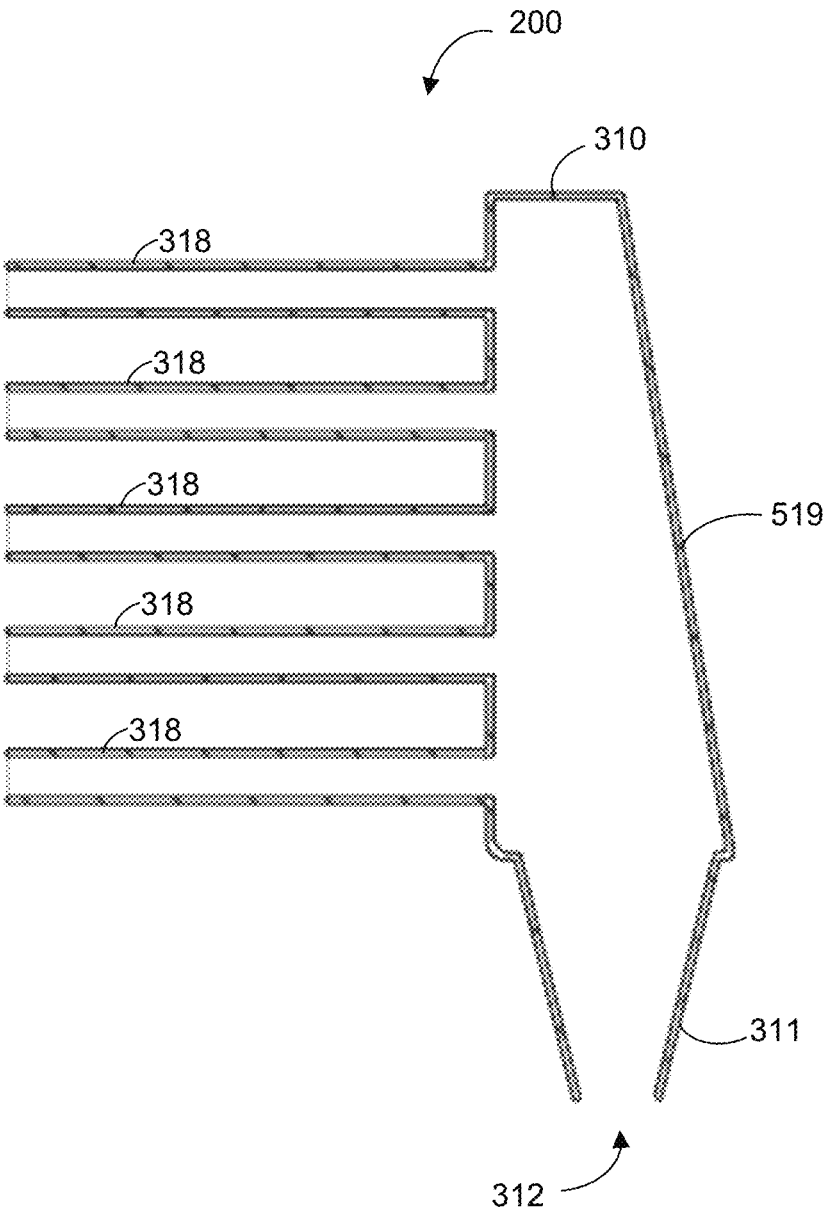
FIG. 8 illustrates a cross-sectional view of an example header tube assembly, in accordance with the disclosed technology.

Referring to FIG. 8, the header tube assembly 200 can have an internal diameter that gradually changes over the length of the header tube assembly 200 while also omitting the inner tube 320. Alternatively or in addition, the header tube assembly 200 can have an internal diameter that gradually increases from the open end to the closed end (e.g., the portion corresponding to the transition wall 311) until a maximum internal diameter is reached. Continuing from the open end to the closed end, the internal diameter can then gradually decrease. A minimum internal diameter can be located proximate the closed end and/or proximate the open end.

In this description, numerous specific details have been set forth. It is to be understood, however, that implementations of the disclosed technology may be practiced without these specific details. In other instances, well-known methods, structures, and techniques have not been shown in detail in order not to obscure an understanding of this description. References to "one embodiment," "an embodiment," "one example," "an example," "some examples," "example embodiment," "various examples," "one implementation," "an implementation," "example implementation," "various implementations," "some implementations," etc., indicate that the implementation(s) of the disclosed technology so described may include a particular feature, structure, or characteristic, but not every implementation necessarily includes the particular feature, structure, or characteristic. Further, repeated use of the phrase "in one implementation" does not necessarily refer to the same implementation, although it may.

Further, certain methods and processes are described herein. It is contemplated that the disclosed methods and processes can include, but do not necessarily include, all steps discussed herein. That is, methods and processes in accordance with the disclosed technology can include some of the disclosed while omitting others. Moreover, methods and processes in accordance with the disclosed technology can include other steps not expressly described herein.

Throughout the specification and the claims, the following terms take at least the meanings explicitly associated herein, unless otherwise indicated. The term "or" is intended to mean an inclusive "or." Further, the terms "a," "an," and "the" are intended to mean one or more unless specified otherwise or clear from the context to be directed to a singular form. By "comprising," "containing," or "including" it is meant that at least the named element, or method step is present in article or method, but does not exclude the presence of other elements or method steps, even if the other such elements or method steps have the same function as what is named.

While certain examples of this disclosure have been described in connection with what is presently considered to be the most practical and various examples, it is to be understood that this disclosure is not to be limited to the disclosed examples, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain examples of the technology and also to enable any person skilled in the art to practice certain examples of this technology, including making and using any apparatuses or systems and performing any incorporated methods. The patentable scope of certain examples of the technology is defined in the claims and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A header tube assembly comprising:

an outer tube having an open end with a first internal diameter and a closed end with a second internal diameter that is greater than the first internal diameter, the outer tube including a plurality of outer apertures extending through a sidewall of the outer tube, each of the plurality of outer apertures being configured to direct a flow of refrigerant between an internal volume of the outer tube and a corresponding refrigerant flow path of a heat exchanger, wherein the outer tube has a transition wall extending from the first internal diameter to a third internal diameter, wherein the outer tube has a tapered wall that tapers inwardly from the third internal diameter to the second internal diameter, and wherein the third internal diameter is a maximum internal diameter;

an inner tube located within the internal volume of the outer tube, the inner tube having (i) an open end proximate the open end of the outer tube, (ii) a closed end proximate the closed end of the outer tube, and (iii) an external diameter that is less than an internal diameter of the outer tube such that a gap exists between the inner tube and the outer tube, the inner tube including a plurality of inner apertures extending through a sidewall of the inner tube, each of the plurality of inner apertures being configured to permit refrigerant to flow therethrough between an internal volume of the inner tube and the gap, wherein the inner tube has a tapered wall that tapers inwardly from the open end to the closed end, and wherein a distance between the tapered wall of the inner tube and the tapered wall of the outer tube is defined by the gap; and a flow valve disposed within the outer tube between the open end of the inner tube and the open end of the outer tube, the flow valve having an aperture extending therethrough, the aperture of the flow valve being at least partially aligned with the open end of the outer tube and the open end of the inner tube.

2. The header tube assembly of claim 1, wherein:

the flow valve is configured to move in a first direction extending from the open end of the outer tube to the closed end of the outer tube and a second direction extending from the closed end of the outer tube to the open end of the outer tube, and the flow valve is configured to move in the first direction to a semi-closed state in response to a flow of refrigerant flowing through the header tube assembly in the first direction.

3. The header tube assembly of claim 1, wherein:

the flow valve is configured to move in a first direction extending from the open end of the outer tube to the closed end of the outer tube and a second direction extending from the closed end of the outer tube to the open end of the outer tube, and the flow valve is configured to move in the second direction to an open state in response to a flow of refrigerant flowing through the header tube assembly in the second direction.

4. The header tube assembly of claim 1 further comprising a nozzle at the open end of the inner tube.

5. The header tube assembly of claim 1, wherein at least one of the plurality of outer apertures is located on a first side of the header tube assembly and at least one of the plurality of outer apertures is located on a second side of the header tube assembly.

6. The header tube assembly of claim 1, wherein the outer tube has a changing diameter along a length of the header tube assembly.

7. The header tube assembly of claim 1, wherein diameters of the plurality of outer apertures increase along a length of outer tube from the open end of the outer tube to the closed end of the outer tube.

8. The header tube assembly of claim 1, wherein diameters of the plurality of outer apertures decrease along a length of outer tube from the open end of the outer tube to the closed end of the outer tube.

9. The header tube assembly of claim 1, wherein diameters of the plurality of inner apertures increase along a length of inner tube from the open end of the inner tube to the closed end of the inner tube.

10. The header tube assembly of claim 1, wherein diameters of the plurality of inner apertures decrease along a length of inner tube from the open end of the inner tube to the closed end of the inner tube.

11. The header tube assembly of claim 1, wherein a diameter of each of the plurality of inner apertures is less than a diameter of a corresponding one of the plurality of outer apertures.

12. The header tube assembly of claim 1, wherein a diameter of each of the plurality of inner apertures is greater than a diameter of a corresponding one of the plurality of outer apertures.

13. The header tube assembly of claim 1, wherein a distance between adjacent pairs of the outer apertures changes along a length of the header tube assembly.

14. The header tube assembly of claim 1, wherein a distance between adjacent pairs of the inner apertures changes along a length of the header tube assembly.

15. The header tube assembly of claim 2, wherein, in the semi-closed state, the flow valve is configured to (i) permit the flow of refrigerant to flow through the aperture of the flow valve and into the internal volume of the inner tube and (ii) prevent the flow of refrigerant between the open end of the outer tube and the gap.

16. The header tube assembly of claim 3, wherein, in the open state, the flow valve is configured to permit the flow of refrigerant through the gap to the open end of the outer tube and through the aperture of the flow valve.

17. A header tube assembly comprising:

a longitudinal housing having an open end with a first internal diameter and a closed end with a second internal diameter that is greater than the first internal diameter, the housing including a plurality of apertures extending through a sidewall of the housing, each of the plurality of apertures being configured to direct a flow of refrigerant between an internal volume of the housing and a corresponding refrigerant flow path of a heat exchanger, wherein the housing has a transition wall extending from the first internal diameter to a third internal diameter, wherein the housing has a tapered wall that tapers inwardly from the third internal diameter to the second internal diameter, and wherein the third internal diameter is a maximum internal diameter; and a flexible check valve disposed at the open end of the housing, the flexible check valve having an opening that is configured to transition between a first state having a first cross sectional area and a second state having a second cross-sectional area that is greater than the first cross-sectional area, wherein the flexible check valve is semi-closed in the first state and open in the second state, and wherein the flexible check valve is configured to transition to the second state when a flow of refrigerant flows through the housing in a direction extending from the closed end to the open end, and the flexible check valve is configured to resist deformation when the flexible check valve is in the first state and the flow of refrigerant flows through the housing in a direction extending from the open end to the closed end.

18. A header tube assembly comprising:

a longitudinal housing having an open end with a first internal diameter and a closed end with a second internal diameter that is greater than the first internal diameter, the housing including:

a plurality of apertures extending through at least one sidewall of the housing, each of the plurality of apertures being configured to direct a flow of refrigerant between an internal volume of the housing and a corresponding refrigerant flow path of a heat exchanger, wherein at least one of the sidewalls of the housing is a transition wall extending from the first internal diameter to a third internal diameter, wherein at least one of the sidewalls of the housing is a tapered wall that tapers inwardly as the tapered wall extends in a direction extending from the third internal diameter to the second internal diameter, and wherein the third internal diameter is a maximum internal diameter, and an inner tube located within the internal volume of the housing, the inner tube having (i) an open end proximate the open end of the housing, (ii) a closed end proximate the closed end of the housing, and (iii) an external diameter that is less than an internal diameter of the housing such that a gap exists between the inner tube and the housing, the inner tube including:

a plurality of inner apertures extending through at least one sidewall of the inner tube, each of the plurality of inner apertures being configured to permit refrigerant to flow therethrough between an internal volume of the inner tube and the gap, wherein at least one of the sidewalls of the inner tube is a tapered wall that tapers inwardly as the tapered wall extends in a direction extending from the open end to the closed end of the inner tube, and wherein a distance between the tapered wall of the inner tube and the tapered wall of the housing is defined by the gap.

* * * * *